US007204452B2

(12) United States Patent
Wilkinson et al.

(10) Patent No.: US 7,204,452 B2
(45) Date of Patent: Apr. 17, 2007

(54) DISPENSER FOR ELONGATE MATERIAL

(75) Inventors: James Wilkinson, East Greenbush, NY (US); Fedor Baranov, East Greenbush, NY (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 11/146,602

(22) Filed: Jun. 7, 2005

(65) Prior Publication Data

US 2006/0273217 A1 Dec. 7, 2006

(51) Int. Cl.
*B65H 75/12* (2006.01)

(52) U.S. Cl. ..... 242/614; 242/396.6; 242/611.1

(58) Field of Classification Search ..... 242/614, 242/614.1, 608, 611, 611.1, 601, 396.6, 396.7, 242/396.8, 588, 588.3, 588.6, 422.4, 598.5, 242/598.6, 397, 398, 566, 615, 128, 129, 242/597.3

See application file for complete search history.

(56) References Cited

U.S. PATENT DOCUMENTS

| | | | | | |
|---|---|---|---|---|---|
| 573,563 | A | | 12/1896 | Yeakel | |
| 1,474,580 | A | | 11/1923 | Clark et al. | |
| 1,783,339 | A | * | 12/1930 | Mitchell | 242/128 |
| 2,647,704 | A | * | 8/1953 | Samler et al. | 242/128 |
| 3,122,113 | A | * | 2/1964 | Edwards | 242/128 |
| 3,693,784 | A | | 9/1972 | Holmes | |
| 3,791,119 | A | * | 2/1974 | Godderidge | 242/128 |
| 3,972,489 | A | * | 8/1976 | Kovaleski | 242/128 |
| 4,111,089 | A | | 9/1978 | Montaruli | |
| 4,142,694 | A | | 3/1979 | Rankin, Jr. | |
| 4,253,570 | A | | 3/1981 | O'Connor et al. | 206/391 |
| 4,582,198 | A | | 4/1986 | Ditton | 206/395 |
| 4,771,889 | A | * | 9/1988 | Bauer et al. | 242/588.3 |
| 4,903,833 | A | | 2/1990 | Beery | |
| 5,165,543 | A | | 11/1992 | Heyda et al. | 206/400 |
| 5,474,254 | A | | 12/1995 | Faulkner | 242/614 |
| 5,529,186 | A | | 6/1996 | Bass | 206/395 |
| 5,897,075 | A | * | 4/1999 | Elder et al. | 242/614 |
| 5,967,451 | A | | 10/1999 | Radaios | |
| 6,003,667 | A | | 12/1999 | Barnett et al. | 206/396 |
| 6,145,780 | A | | 11/2000 | Fontana | 242/588.1 |
| 2002/0125161 | A1 | | 9/2002 | Cote | 206/408 |
| 2003/0080011 | A1 | | 5/2003 | You et al. | 206/397 |
| 2003/0098253 | A1 | | 5/2003 | You et al. | 206/408 |

FOREIGN PATENT DOCUMENTS

| | | |
|---|---|---|
| EP | 0 826 618 A1 | 3/1998 |

* cited by examiner

*Primary Examiner*—William A. Rivera
(74) *Attorney, Agent, or Firm*—DLA Piper US LLP

(57) ABSTRACT

A dispenser for an elongate material is provided having a support and a spool rotatably mounted in the support. The spool includes a core and two ends extending radially outward from the core. At least one ring on the support encircles a respective end of the spool. In one embodiment, the radial outside of each ring is provided with a formation tapering towards the middle of the spool.

35 Claims, 3 Drawing Sheets

DISPENSER FOR ELONGATE MATERIAL

FIELD OF INVENTION

The present invention relates to a device for holding and/or dispensing elongate materials, such as wire, from a spool or the like.

BACKGROUND OF INVENTION

Various devices are known for holding and dispensing cable and other elongate material. Some of these devices comprise a container with a spool mounted inside the container. The cable or other elongate material is wound on the spool. When material is to be dispensed from the spool, the spool is intended to rotate while the outer container remains stationary. With some previously proposed dispensers, the user draws off material from the spool by pulling on a free end of the material. When the user stops pulling, the spool may continue to rotate because of the angular momentum of the rotating spool of material, especially when the material is heavy, such as metal wire or fiber optic cable. This can result in the outer turns of wire on the spool becoming slack, and becoming trapped between the spool and the container and/or wrapped round supports for the spool inside the container, so that the material jams next time the user attempts to draw some off.

SUMMARY OF INVENTION

One embodiment of the present invention provides a dispenser for elongate material, comprising a support, a spool rotatably mounted in the support, the spool having a core and two ends extending radially outward from the core, and at least one ring on the support, encircling a respective end of the core, the radial outside of the at least one ring being provided with a formation tapering towards the middle of the spool.

Another embodiment of the present invention provides a dispenser for elongate material, comprising a holder, a spool rotatably mounted in the holder, the spool having a core and two ends extending radially outward from the core, at least one ring on the holder, encircling a respective end of the core, and a plurality of friction ribs extending between the at least one said ring and the respective end of the core.

Another embodiment of the present invention provides an end plate for a dispenser for elongate material, comprising a central support to rotatably mount an end of a spool on one side of the end plate, a ring having a generally cylindrical inside surface concentric with the support, a plurality of guide ribs on the outside of the ring tapering towards said one side of the end plate, and a plurality of flexible friction ribs extending axially from the inside of said ring.

BRIEF DESCRIPTION OF THE DRAWINGS

For the purpose of illustrating the invention, there are shown in the drawings various forms which are presently disclosed; it being understood, however, that this invention is not limited to the precise arrangements and instrumentalities particularly shown.

DETAILED DESCRIPTION OF THE DRAWINGS

Figure 1:
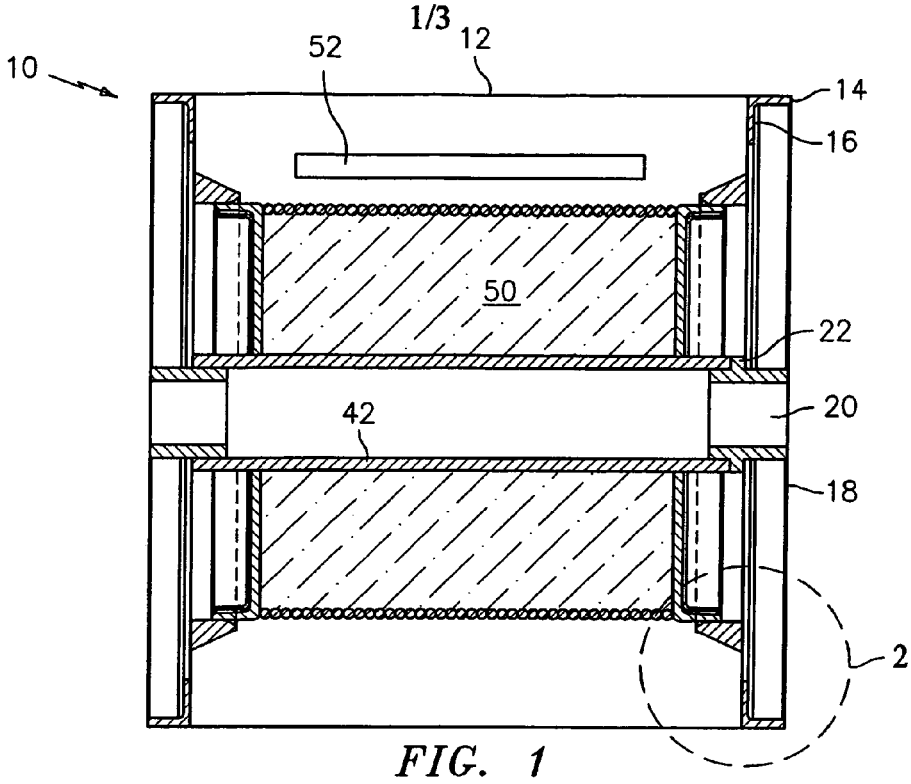
FIG. 1 is an axial section through an embodiment of a dispenser as contemplated by the invention.

In the drawings, where like elements are identified by like numerals, there is shown an embodiment of a container for storing and dispensing elongate material, for example, electrical or fiber optic cable. One form of container, identified generally by the numeral 10, comprises a box 12. The box 12 may be made of any suitable reasonably rigid material. The box 12 has a body with two ends 14. As shown in the drawings, the ends of the box 14 are square.

Figure 3:
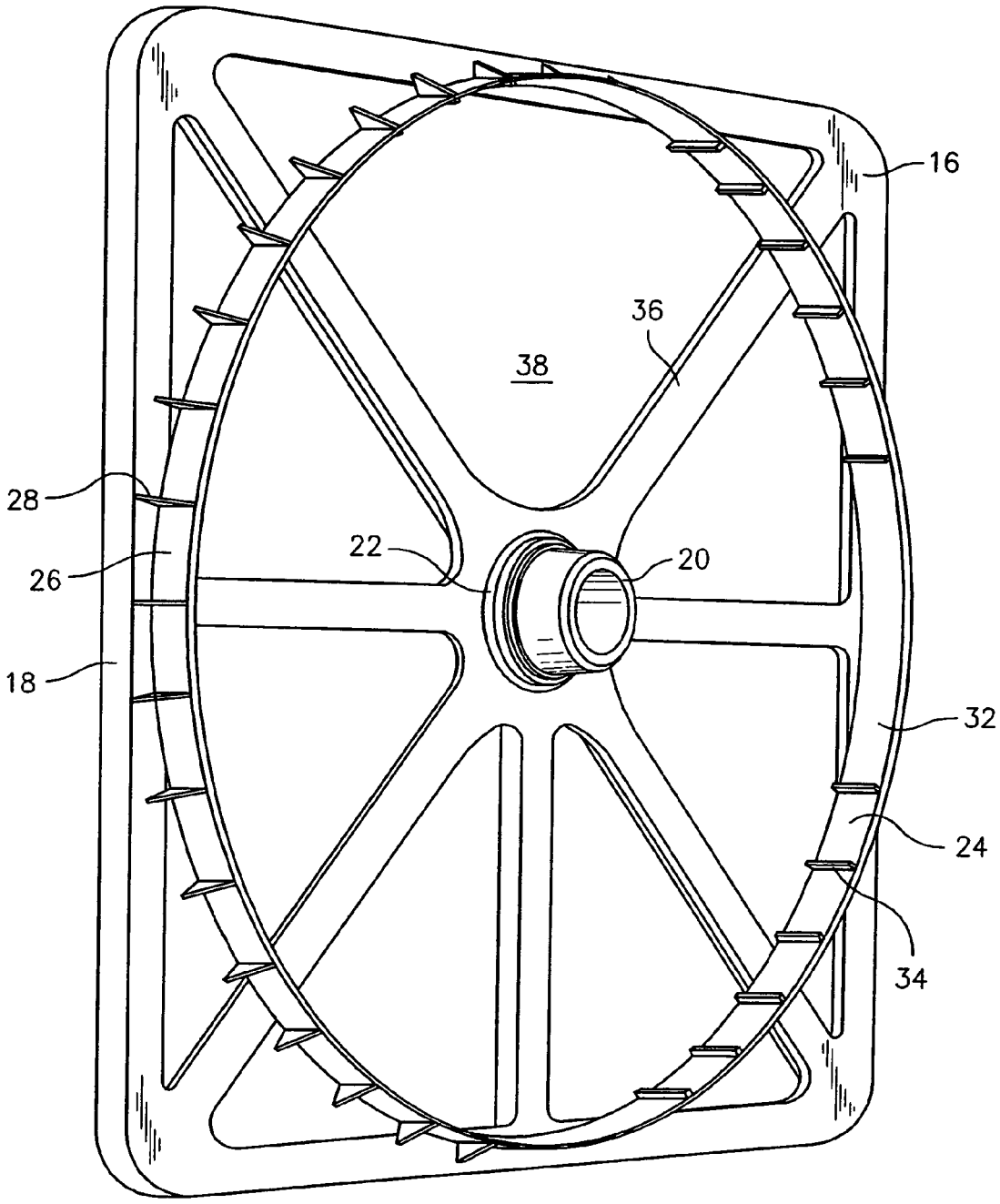
FIG. 3 is a perspective view of an end frame forming part of the dispenser shown in FIG. 1.

Inside each end 14 of the box 12 is an end plate 16, best seen in FIG. 3. Each end plate 16 has an outer frame 18 that is dimensioned to fit snugly within the end 14 of the box 12. In the center of the end plate 16 is a cylindrical or frustoconical arbor 20 extending towards the center of the box 12. The arbor 20 is surrounded by a shoulder 22.

The end plate 16 also bears a ring wall 24 which, as best seen in FIG. 3, is slightly smaller in diameter than the width between opposite sides of the outer frame 18. The ring wall 24 is concentric with the arbor 20 and extends axially from the outer frame 18 towards the middle of the box 12. The ring wall 24 has on its outer face 26 a number of triangular ribs 28 that are widest where they meet the outer frame 18, and taper to meet the ring wall 24 close to the edge 30 of the wall nearest the middle of the box. The outer edges of the triangular ribs 28 effectively define an imaginary frustoconical surface.

On the inside face 32 of the ring wall 24 are ribs 34. The ribs 34 are sufficiently thin that they will flex readily in use, as explained below. The ribs 34 extend substantially axially over the full width of the wall 24. The axially inner ends of the ribs 34, near the edge 30 of the wall 24, may be rounded or chamfered. The axially outer ends of the ribs 34 are not joined to the outer frame 18. As shown in FIG. 3, the outer frame 18 consists of bars 36 with large gaps 38 between them. The ribs 34 are positioned over the gaps, evenly spaced along the wall 24. Ribs 34 that would merge into the bars forming the frame 18 are omitted.

Figure 4:
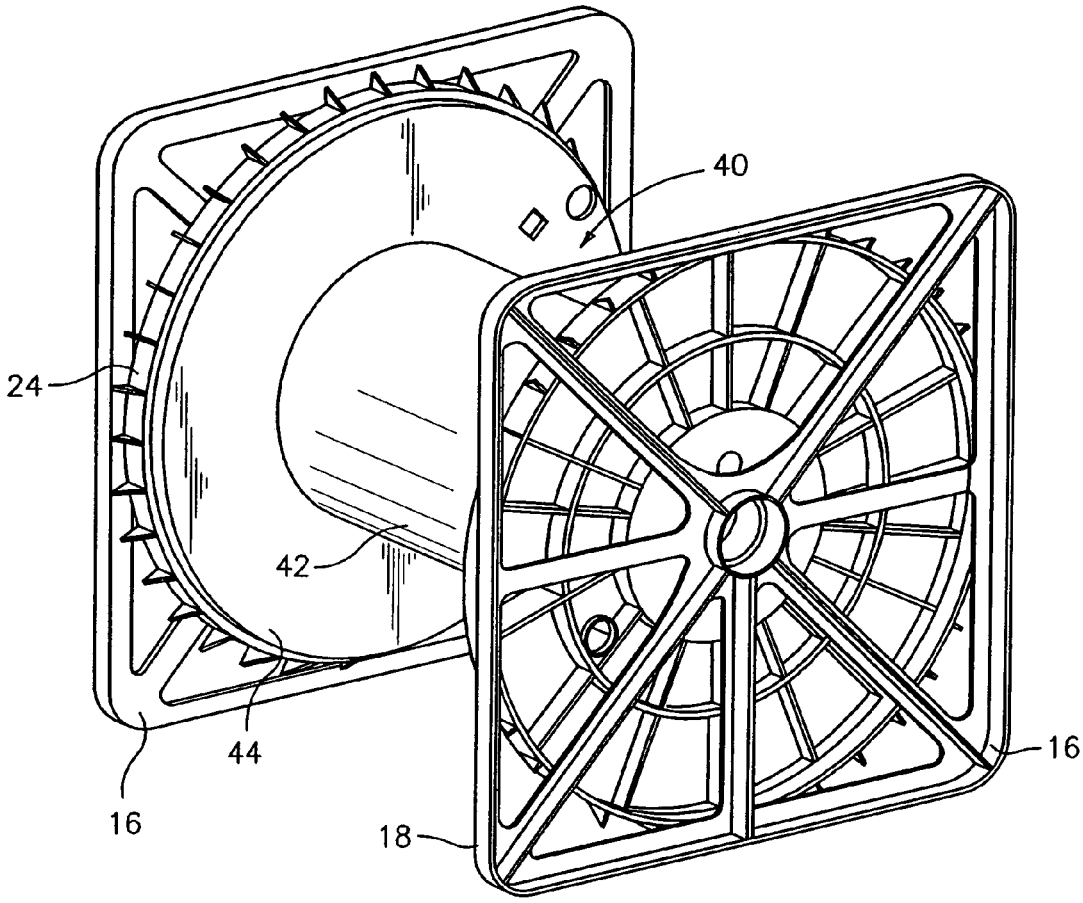
FIG. 4 is a perspective view of a spool and two end frames forming part of the dispenser as shown in FIG. 2.

Between the two end plates 16 is a spool 40. The spool 40 has a cylindrical core 42 that fits over the arbors 20 and between the shoulders 22 with a sufficient play to allow the spool 40 to rotate freely, while remaining in position between the end plates 16. The end plates 16 do not rotate. At each end of the core 42 is an end 44 comprising a radially extending end wall 46. The end walls 46 may be substantially flat or may diverge radially outwardly, and are smooth on their sides facing the middle of the spool 40. The radially outer rims of the ends 44 comprise generally cylindrical skirts 48 that face the ring walls 24 on the end plates 16. The diameter of the skirts 48 is such that the flexible ribs 34 press lightly against the skirts 48, as will be explained below. As shown in FIG. 4, the sides of the end walls 46 facing outwards may have stiffening ribs or other structures within the skirts 48.

Figure 2:
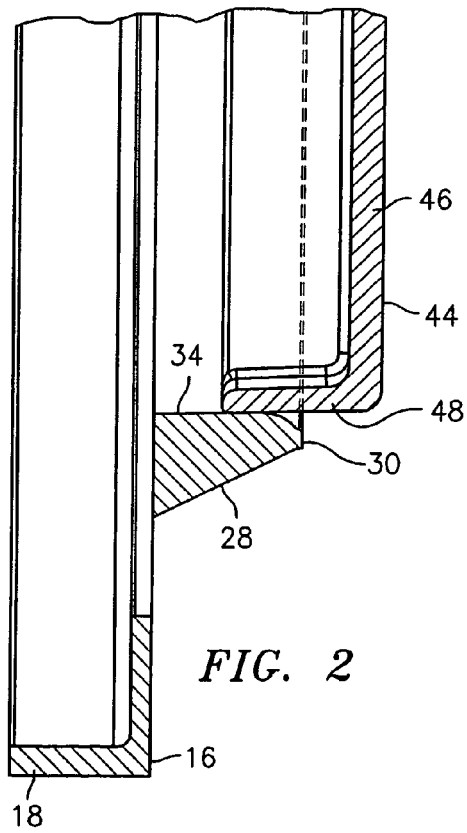
FIG. 2 is an enlarged view of the detail 2 of FIG. 1, an outer box being omitted for clarity.

As shown in FIG. 2, the join between the skirt 48 of each spool end 44 and the end wall 46 is slightly closer to the middle of the box 12 than is the inner edge 30 of the wall 24. The exposed length of the skirt 48 may be sufficient that the axial play of the spool 40 between the shoulders 22 does not result in the ring wall 24 overhanging the end walls 46 of the spool. The exposed length of the skirt 48 may be tapered or rounded to merge smoothly into the end walls 46.

In use, a length of elongate material 50, which may be, for example, electrical wire or cable or fiber optic cable, is wound in a coil round the core 42 of the spool 40, between the end walls 46. A free end of the elongate material is led off from the outer surface of the coil generally tangentially, and is fed out through a hole or slot 52 in the box 12. When a user wants a length of the elongate material, the user pulls on the free end, and draws the material off through the slot 52. The spool 40 and the coil of material 50 rotate. The arbors 20 inside the ends of the core 42 act as plain bearings, supporting and guiding the spool 40 while permitting the spool to rotate. Especially if the user pulls the free end rapidly, the spool 40 can acquire a substantial angular velocity. Especially if the material 50 is heavy, for example, cable, the spool 40 can acquire a substantial angular momentum.

When the user has drawn off a sufficient length of material, the user may abruptly cease to pull on the free end, and may hold the free end to prevent more material from feeding off the coil. However, the spool 40 tends to continue to rotate, because of its acquired angular momentum. As a result, the outermost turns of the coil of material 50 may become expanded, and may not remain in place on the spool.

In the container 10 shown in the drawings, the flexible ribs 34, which are fixed to the ring walls 24 and thus to the end plates 16, press lightly on the skirts 48 of the spool ends 44. The stiffness of the flexible ribs 34, the diameter of the skirts 48 and the diameter, when the flexible ribs 34 are unstressed, of the space between the ribs, are selected in combination with the material of the spool and the end plates to select the frictional drag on the spool 40. The frictional drag is selected so that the user does not feel an excessive resistance to drawing off the material 50, and the material 50 is not subjected to an undue tension, but so that the braking action stops the rotation of the spool promptly when the user ceases to pull on the free end of the material 50.

If the outer turns of the coil of material 50 do become expanded and displaced, the flexible ribs 34, which bridge the gap between the rotatable spool ends 44 and the non-rotatable ring walls 24, hinder the material 50 from entering the gap and jamming the rotation. The triangular ribs 28 hinder the material 50 from becoming wound round the outside of the ring walls 24, because the sloping or conical shape defined by the ribs 28 encourages the material to slide off the ribs, and back onto the spool 40, as soon as a tension is applied to the free end of the material. If the elongate material tends to catch on the exposed part of the skirts 48, any rounding or taper of these parts of the skirts may encourage the material to slide off the spool ends 44 and back onto the main coil of the material 50.

To assemble the container 10, the spool 40 is manufactured and, if necessary, assembled, and the material 50 is wound onto the spool. The free outer end of the material may be attached or secured temporarily to the outer end of the coil. The end plates 16 may be attached to the insides of the ends 14 of the box 12, for example, with adhesive, or by tabs on the end plates 16 engaging slots in the box 12, or in any other convenient way. Alternatively, the end plates 16 may simply be a snug fit within the box 12.

The box 12, including the end plates 16, is then assembled round the loaded spool 40, 50. Because of the friction ribs 34, the spool ends 44 are a force fit within the ring walls 24. However, the rounded or chamfered ends of the ribs 34 assist the spool ends 44 in deflecting the friction ribs 34 and fitting between them. The assembled box 12 may have a top or other flap that can be opened so that, when the material 50 is to be used, the free end can be retrieved and fed out through the slot 52.

Although specific embodiments have been described, various modifications may be made without departing from the scope and spirit of the invention as defined by the appended claims. For example, depending on the size of the spool 50, the box 12 may be made of cardboard. The box can alternatively be made from another substantially rigid material, for example, layered paper stock or plastic. The spool 40 and the end plates 16 have been shown in the drawings as being made of molded plastic. The spool and the end plates can alternatively be made of another suitable material, or can be fabricated from components, which may be of different materials. It is not necessary for the box ends 14 and the end plates 16 to be distinct components.

The dispenser 10 has been shown with an end plate at each end, each end plate having an arbor 20 and a ring wall 24, each ring wall 24 having triangular ribs 28 and having friction ribs 34 bearing on the skirt 48 of the spool 40. However, arrangements are possible in which some of those features are provided at only one end. In particular, in a dispenser intended to be used with the axis of the spool 40 vertical, and with a definite top and bottom, the material 50 might consistently drop to the bottom end. The triangular ribs 28 might then be wanted only at the bottom end. The ring wall 24 and friction ribs 34 might then be wanted only at the bottom for the purpose of preventing the elongate material from jamming between the spool 40 and the end plate 16, but might be wanted at the top for their frictional action. The top arbor 20 might still be wanted to stabilize the spool 40, and the top end plate 16 might still be wanted as a mounting for the top arbor 20 even if the top ring wall 24 was omitted.

The shapes and sizes of the various components may vary depending on the materials used for the container, on the size of the container, and on the properties of the elongate material 50 with which the container is intended to be used. For example, if components are described as straight or cylindrical, and are made of molded plastic, those components may in practice be tapered by several degrees for easier demolding.

As shown in FIG. 2, the outer edges of the triangular ribs 28 effectively define an imaginary frustoconical surface with a cone half angle of about 300. It is not necessary for the ribs to be triangular, defining a frustoconical surface. For example, the outer edges of the ribs could be concave, defining an imaginary surface that fans out like the bell of a trumpet. The angle of taper, or the minimum angle of taper, is then selected to be sufficient to guide the elongate material 50 off the ribs and back into the spool 40. An appropriate numerical value for the minimum angle of taper depends on the size of the container 12 and the properties of the material 50.

As shown in FIG. 2, there is a short width 60 of the wall 24 between the ends of the ribs 28 and the edge 30 of the wall. It is not necessary for there to be such a width 60 of wall with no ribs. The sloping edges of the ribs 28 may meet the edge 30 of the wall exactly, or the ribs 28 may have a residual height at their narrow ends. If there is a width 60 of wall with no ribs between the ends of the ribs 28 and the edge 30 of the wall 24, that width 60 should be narrow enough that the material wound on the spool does not lodge stably thereon.

It will be appreciated by those skilled in the art, that the present invention may be practiced in various alternate forms and configurations. The previously detailed description of the disclosed embodiments is presented for purposes of clarity of understanding only, and no unnecessary limitations should be implied therefrom.

I claim:

1. A dispenser for elongate material, comprising:

a support;

at least one end plate, the support fixed to the end plate;

a spool mounted on the support, the spool having a core and two ends extending radially outward from the core;

at least one ring on the end plate, the at least one ring encircling a respective end of the spool, the radial outside of at least one said ring being provided with a formation tapering from the end plate towards the core of the spool.

2. A dispenser according to claim 1, further comprising a pair of end plates, a pair of supports and a pair of rings, each ring encircling a respective end of the spool.

3. A dispenser according to claim 1, wherein said respective spool end has at its periphery a skirt extending axially away from the core of the spool and facing radially outwards, facing the relatively inner surface of the at least one ring.

4. A dispenser according to claim 1, wherein said tapering formation comprises a plurality of guide ribs on the relatively outer surface outside of said at least one ring.

5. A dispenser according to claim 4, wherein the guide ribs are generally triangular.

6. A dispenser according to claim 1, further comprising a plurality of friction ribs extending between at least one said ring and the respective end of the spool.

7. A dispenser according to claim 6, wherein said friction ribs are attached to said ring and press against a rim of said respective end of the spool.

8. A dispenser according to claim 6, wherein the inside of said ring is generally cylindrical, the outside of said rim is generally cylindrical, and said ribs extend axially over the inside of said ring.

9. A dispenser according to claim 6, wherein said fiction, ribs are flexible, are fixed to one of said ring and said core, and press against the other of said ring and said core.

10. A dispenser according to claim 1, wherein the support further comprises a pair of end plates each comprising a support for said spool, at least one of said end plates comprising a respective said ring with said support for said spool at the center of said ring.

11. A dispenser according to claim 10, wherein each said support for said spool comprises an arbor for an end of the core of the spool.

12. A dispenser according to claim 1, further comprising a box enclosing said spool.

13. A dispenser according to claim 12, further comprising a pair of end plates within said box, each end plate comprising a support for said spool, at least one of said end plates comprising a respective said ring with said support for said spool at the center of said ring.

14. A dispenser for elongate material, comprising:

a holder;

a spool rotatably mounted in the holder, the spool having a core and at least one end extending radially outward from the core;

at least one ring on the holder, encircling a respective end of the core; and a plurality of friction ribs forming a frictional engagement between said at least one ring and the respective end of the core.

15. A dispenser according to claim 14, wherein said at least one ring comprises a pair of rings each encircling a respective end of the spool.

16. A dispenser according to claim 14, wherein said at least one spool end has at its periphery a skirt extending axially away from the middle of the spool and facing radially outwards, facing the respective said ring.

17. A dispenser according to claim 14, wherein said friction ribs are attached to said ring and press against a rim of said respective end of the spool.

18. A dispenser according to claim 14, wherein the inside of said ring is generally cylindrical, the outside of said rim is generally cylindrical, and said ribs extend axially over the inside of said ring.

19. A dispenser according to claim 14, wherein said friction ribs are flexible, are fixed to one of said ring and said spool, and press against the other of said ring and said spool.

20. A dispenser according to claim 14, wherein the holder further comprises a pair of end plates, each comprising one of said rings and each comprising a support for said spool at the center of said ring.

21. A dispenser according to claim 20, wherein each said support for said spool comprises an arbor for an end of the core of the spool.

22. A dispenser according to claim 14, further comprising a box enclosing said spool.

23. A dispenser for elongate material, comprising:

a box;

a pair of end plates within the box, each comprising a ring having a generally cylindrical inside surface and an arbor at the center of said ring;

a spool rotatably mounted on said arbors, the spool having a core and two ends extending radially outward from the core, wherein each said spool end has at its periphery a skirt extending axially away from the middle of the spool, said skirt having a generally cylindrical outside surface facing the inside surface of the respective said ring;

a plurality of generally triangular guide ribs on the outside. of each ring tapering towards the middle of the spool; and a plurality of flexible friction ribs extending axially on the inside of said ring pressing against the skirt of said respective spool end.

24. An end plate for a dispenser for elongate material, comprising:

a central support to rotatably mount an end of a spool on one side of the end plate;

a ring having a generally cylindrical inside surface concentric with the support;

a plurality of guide ribs on the outside of the ring tapering towards said one side of the end plate; and a plurality of flexible friction ribs extending axially from the inside of said ring.

25. A dispenser for elongate material, comprising:

a support;

a spool rotatably mounted in the support, the spool having a core and two ends extending radially outward from the core;

a pair of rings on the support, each ring encircling a respective end of the spool, the radial outside of at least one of said rings being provided with a formation tapering towards the middle of the spool.

26. A dispenser for elongate material, comprising:

a support;

a spool rotatably mounted in the support, the spool having a core and two ends extending radially outward from the core;

at least one ring on the support, encircling a respective end of the spool, the radial outside of at least one said ring being provided with a formation tapering towards the middle of the spool; and said respective spool end has at its periphery a skirt extending axially away from the middle of the spool and facing radially outwards, facing the said at least one ring.

27. A dispenser for elongate material, comprising:

a support;

a spool rotatably mounted in the support, the spool having a core and two ends extending radially outward from the core;

at least one ring on the support, encircling a respective end of the spool, the radial outside of at least one said ring being provided with a formation tapering towards the middle of the spool, said tapering formation comprises a plurality of guide ribs on the outside of said at least one ring.

28. A dispenser according to claim 27, wherein the guide ribs are generally triangular.

29. A dispenser for elongate material, comprising:

a support;

a spool rotatably mounted in the support, the spool having a core and two ends extending radially outward from the core;

at least one ring on the support, encircling a respective end of the spool, the radial outside of at least one said ring being provided with a formation tapering towards the middle of the spool; and a plurality of friction ribs extending between said at least one ring and the respective end of the spool.

30. A dispenser according to claim 29, wherein said friction ribs are attached to said ring and press against a rim of said respective end of the spool.

31. A dispenser according to claim 29, wherein the inside of said ring is generally cylindrical, the outside of said rim is generally cylindrical, and said ribs extend axially over the inside of said ring.

32. A dispenser according to claim 29, wherein said fiction ribs are flexible, are fixed to one of said ring and said core, and press against the other of said ring and said core.

33. A dispenser for elongate material, comprising:

a support;

a spool rotatably mounted in the support, the spool having a core and two ends extending radially outward from the core;

at least one ring on the support, encircling a respective end of the spool, the radial outside of at least one said ring being provided with a formation tapering towards the middle of the spool, the support further comprises a pair of end plates each comprising a support for said spool, at least one of said end plates comprising a respective said ring with said support for said spool at the center of said ring.

34. A dispenser according to claim 33, wherein each said support for said spool comprises an arbor for an end of the core of the spool.

35. A dispenser for elongate material, comprising:

a spool having a core and two ends extending radially outward from the core;

at least one ring, encircling a respective end of the spool, the radial outside of at least one said ring being provided with a formation tapering towards the middle of the spool;

a box enclosing said spool; and a pair of end plates within said box, each end plate comprising a support for said spool, at least one of said end plates comprising the ring, with said support for said spool at the center of said ring.

* * * * *

UNITED STATES PATENT AND TRADEMARK OFFICE

CERTIFICATE OF CORRECTION

PATENT NO. : 7,204,452 B2
APPLICATION NO. : 11/146602
DATED : April 17, 2007
INVENTOR(S) : Wilkinson et al.

It is certified that error appears in the above-identified patent and that said Letters Patent is hereby corrected as shown below:

In Column 4
At line 42, change “300” to --30°--.

Signed and Sealed this

Fourteenth Day of August, 2007

JON W. DUDAS
*Director of the United States Patent and Trademark Office*